US005443314A

United States Patent [19]

Gatlin

[11] Patent Number: 5,443,314

[45] Date of Patent: Aug. 22, 1995

[54] MIXING ASSEMBLY

[75] Inventor: Noel A. Gatlin, Clifton, Ill.

[73] Assignee: United Coatings, Inc., Kankakee, Ill.

[21] Appl. No.: 89,123

[22] Filed: Jul. 9, 1993

[51] Int. Cl.[6] ..... B01F 11/00

[52] U.S. Cl. ..... 366/215; 366/111; 366/208; 366/605

[58] Field of Search ..... 366/208, 209, 213, 215, 366/216, 219, 605, 110, 111

[56] References Cited

U.S. PATENT DOCUMENTS

| | | | |
|---|---|---|---|
| D. 254,973 | 5/1980 | Ahrenskou-Sörensen . | |
| 709,461 | 9/1902 | Beach | 366/210 |
| 835,846 | 11/1906 | Blaloch . | |
| 1,448,446 | 3/1923 | Hulbert . | |
| 1,463,626 | 7/1923 | Marrazzo . | |
| 1,755,763 | 4/1930 | Barber . | |
| 2,022,527 | 11/1935 | Schletz | 366/605 |
| 2,797,902 | 7/1957 | Buegler . | |
| 2,894,309 | 7/1959 | Brzowski . | |
| 3,018,092 | 1/1962 | Johnson . | |
| 3,181,841 | 5/1965 | Boehm . | |
| 3,229,964 | 1/1966 | Wiseman . | |
| 3,265,366 | 8/1966 | Warner . | |
| 3,284,057 | 11/1966 | Duquette . | |
| 3,301,534 | 1/1967 | Orser . | |
| 3,328,004 | 6/1967 | Beichle | 366/209 |
| 3,388,895 | 6/1968 | Ogren et al. . | |
| 3,415,495 | 12/1968 | Grubelic . | |
| 3,421,053 | 1/1969 | Rinard et al. . | |
| 3,437,317 | 4/1969 | Micin . | |
| 3,480,259 | 11/1969 | Schletz . | |
| 3,542,344 | 11/1970 | Oberhauser . | |
| 3,609,921 | 10/1971 | Foster et al. . | |
| 3,706,443 | 12/1972 | Oberhauser . | |
| 3,735,962 | 5/1973 | Pagano . | |
| 3,880,408 | 4/1975 | Karjalainen . | |
| 4,134,689 | 1/1979 | Ahrenskou-Sörensen . | |
| 4,146,335 | 3/1979 | Hutchings et al. . | |
| 4,173,418 | 11/1979 | Vork | 366/605 |
| 4,235,553 | 11/1980 | Gall . | |
| 4,281,936 | 8/1981 | Schotter et al. . | |
| 4,415,270 | 11/1983 | Heinis et al. . | |
| 4,422,768 | 12/1983 | Soloman . | |
| 4,497,581 | 2/1985 | Miller . | |
| 4,588,302 | 5/1986 | Pizzi | 366/605 |
| 4,662,760 | 5/1987 | Powell . | |
| 4,789,245 | 12/1988 | Morbeck . | |
| 4,842,415 | 6/1989 | Cane et al. . | |
| 5,066,136 | 11/1991 | Johnson | 366/605 |
| 5,261,744 | 11/1993 | Brunn | 366/605 |

FOREIGN PATENT DOCUMENTS

| | | | |
|---|---|---|---|
| 478864 | 1/1938 | United Kingdom . | |
| 1240592 | 7/1971 | United Kingdom | 366/111 |
| 08045 | 6/1991 | WIPO | 366/605 |

*Primary Examiner*—David A. Scherbel
*Assistant Examiner*—Terrence R. Till
*Attorney, Agent, or Firm*—Welsh & Katz, Ltd.

[57] ABSTRACT

A mixing assembly is provided which mixes liquids within a container. The mixing assembly has a vertically extending support frame enclosed within an outer cabinet. Attached to at least one crank which is in turn attached to the support frame, is a vertically extending rigid frame. A rotary drive apparatus rotates the crank to cause the rigid frame to orbit in a vertical plane about a horizontal axis. The mixing apparatus also includes an attachment device which removably attaches the container to the rigid frame. When the attachment device is in a lower position, the attachment device urges an upper support member against the top of the container to clamp the container between the upper support member and a lower support member. The attachment device also includes a spring to move the upper support member upward and off the top of the container when the attachment device is not locked in a lower position.

21 Claims, 3 Drawing Sheets

MIXING ASSEMBLY

BACKGROUND OF THE INVENTION

The invention generally relates to an assembly for mixing liquids and more particularly to a machine for agitating and mixing a liquid within a container such as paints or the like.

Devices which mix liquids within a container by rapid, general oscillatory movement of the container are well known. However, to cause rapid movement of the container, forces must be applied to the container by the mixing device. The mixing device must balance the forces applied to the container, or vibration and/or damage to the mixing device may result.

To balance the forces applied to the container, several prior art devices were developed which spins the container about one or more axes which correspond to a central axis of the container. Because the container is being spun about the central axis, the centrifugal forces created by the rotation of the liquid are directed against the container and not against the machine. The mixing effect of these devices is minimal, however, along the axis of rotation. Therefore, these machines must be operated for a longer period of time to perform adequate mixing.

In addition, to prevent damage to the container by the mixing device during movement of the container, the container must be securely fastened to the mixing apparatus. The containers, however, are typically fungible; and therefore, the device which fastens the container to the mixing device should facilitate attachment and removal of the container. The attaching device should also provide some indication of when the container has been securely attached to the mixing device before operation of the mixing device. Furthermore, the attachment device must be able to attach containers having slightly differing dimensions without compromising the attachment or clamping force applied by the attaching device to the container.

It is therefore an object of this invention to provide a device which mixes liquids held within a container.

It is a further object of the present invention to provide a device which balances forces arising from the mixing movement of the container.

Yet another object of the present invention is to provide a device which mixes the liquids quickly.

It is a still further object of the present invention to provide a mixing device which allows quick and secure attachment and detachment of the container. A related object of the present invention is to provide a mixing device which provides an indication of when the secure attachment has occurred.

It is also an object of the present invention to provide a device which can securely mix liquids within containers having slightly varying dimensions.

SUMMARY OF THE INVENTION

Accordingly an assembly is provided for mixing fluid held within a container. The mixing assembly includes a rigid frame having a device for removably securing the container to the frame. The assembly includes an intermediate frame which is connected to and moves the rigid frame, and therefore the container, in a generally circular planar orbit about a first axis normal to the plane of the orbit. The orbital movement agitates the liquid within the container to cause a complete intermixing of the liquid in a short time.

The device which removably secures the container to the rigid frame supports the container on a lower member and resiliently urges an upper member against the top of the container. The device compensates for containers having differing heights and widths. The securing device also includes a resilient spring for moving the upper member off the top of the container to facilitate removal of the container from the mixing assembly.

More particularly, the mixing assembly has a generally vertically extending support frame, a first bearing means, fixedly attached to the support frame, and a first axle horizontally extending through and rotatably mounted in said first bearing means. A rotational drive is operatively attached to the first axle for rotating the first axle. A crank is fixedly attached to the first axle, wherein the crank spins about a horizontal axis defined by the first axle when the first axle is rotated.

The mixing assembly also has a generally vertically extending rigid frame, a second bearing fixedly attached to the rigid frame, and a second axle extending through and rotatably mounted in the second bearing, the second axle being generally aligned with the first axle and fixedly attached to the crank at a point spaced from the connection between the crank and the first axle, wherein the second axle orbits in a vertical plane about the horizontal axis when the crank spins about the horizontal axis.

The mixing assembly further includes a device for removably securing the container, the securing device is secured to the rigid frame. Thus, the container is moved in an orbit in a vertical plane about an axis parallel to the horizontal axis by the spinning action of the crank as transmitted to the container and the fluid.

DESCRIPTION OF THE PREFERRED EMBODIMENT

Figure 1:
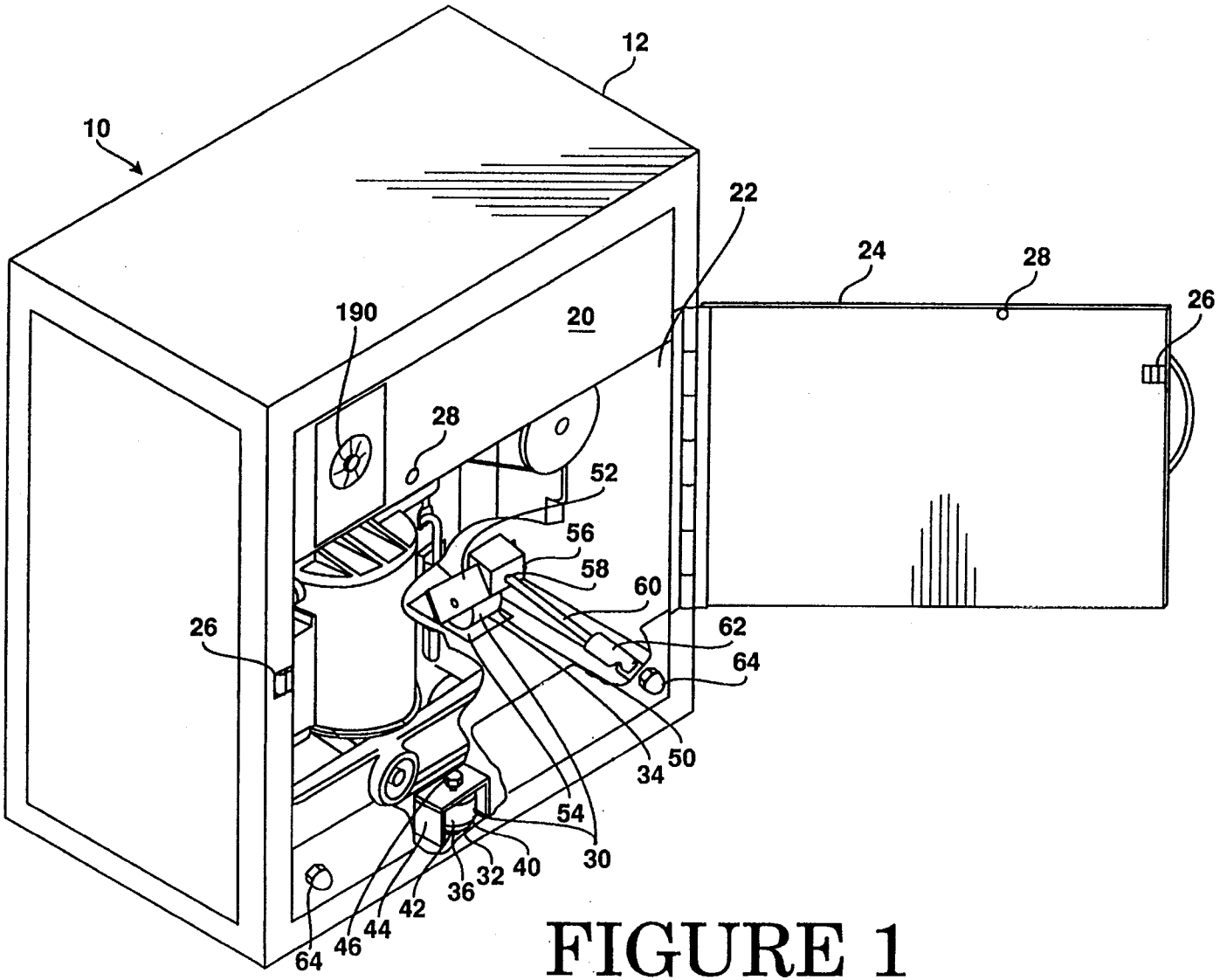
FIG. 1 is a perspective view, with parts broken away, of a mixing assembly embodying the present invention.
Figure 2:
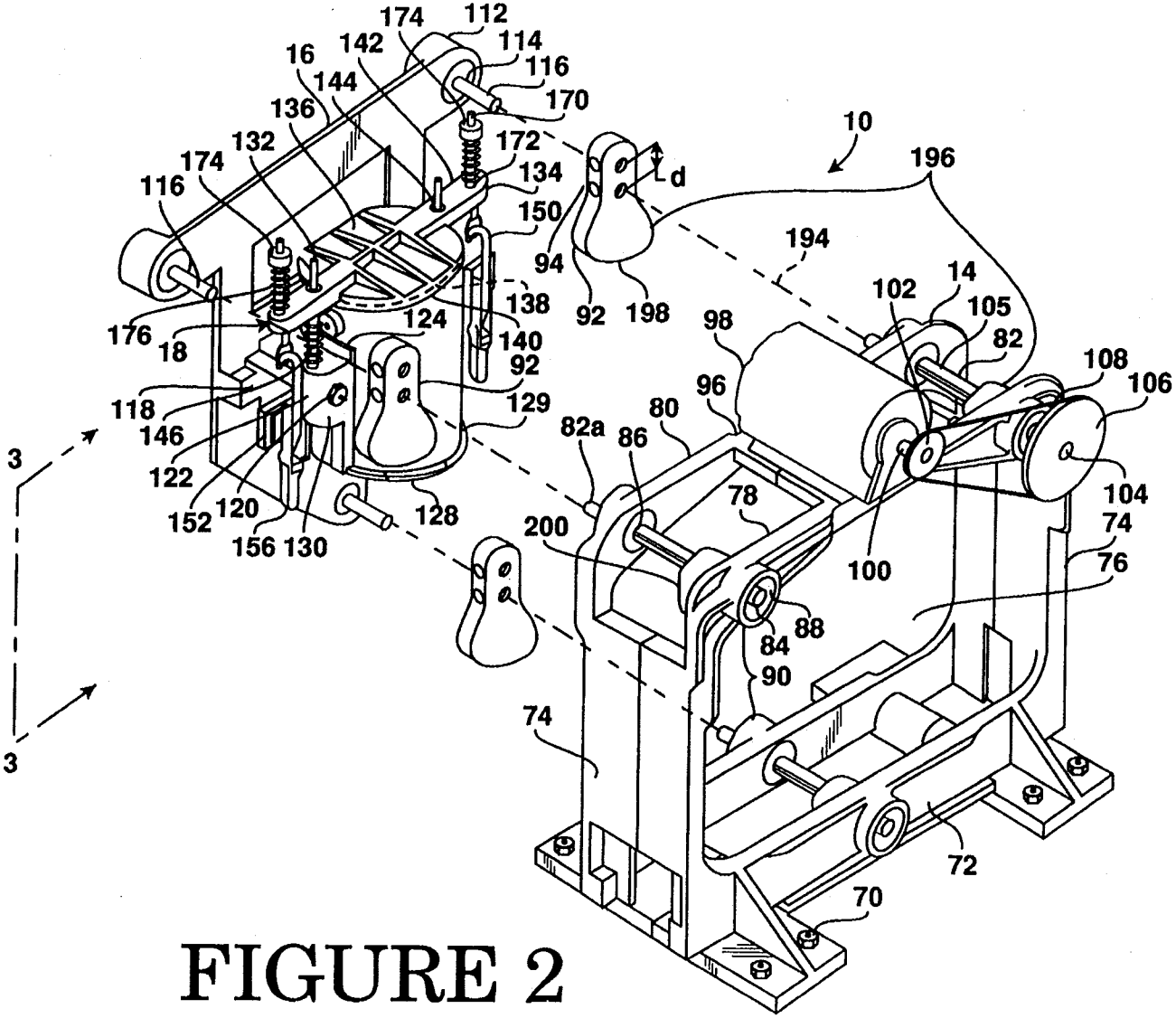
FIG. 2 is an exploded perspective view of the mixing device of FIG. 1 with the outer cabinet removed for clarity.

Referring to FIGS. 1 and 2, the preferred embodiment of the mixing apparatus is generally indicated at 10. The mixing apparatus 10 includes an outer cabinet 12. Rigidly attached to the cabinet 12 and contained within the cabinet is support frame 14. Movably connected to the support frame 14 is a generally vertically extending rigid frame 16, and mounted to the rigid frame is an attachment device, generally indicated at 18, for securely and removably attaching a liquid-filled container to the rigid frame.

Referring to FIG. 1, the cabinet 12 is of a general box-like configuration and is preferably made of a rigid material such as a high density plastic or metal. The cabinet 12 functions to prevent inadvertent contact with the moving rigid frame 16 during operation of the mixing apparatus 10 and shield the surrounding environment from the potential spillage of the contents of a container during mixing.

The front 20 of the cabinet 12 forms a generally rectangular opening 22, and the cabinet includes a door 24 which is hingably mounted to the front 20 along the side of the opening 22. The door 24 is of a size so that it covers the opening 22 when the door is in a closed position, and the door may be clear to allow viewing of the interior of the cabinet 12 during operation of the mixing device 10. The door 24 and front 20 of the cabinet 12 include a cabinet latching mechanism 26 so that the door may be removably secured in the closed position.

The front 20 and door 24 of the cabinet 12 may also include a sensing device 28 which gives an indication when the door has been securely attached by the latching mechanism 26. The sensing device may be a normally open electrical switch or the like.

To provide selected mobility of the cabinet 12, the cabinet includes retractable rollers 30. The rollers 30 preferably include a front roller 32 and a pair of back rollers 34 arranged to support the cabinet 12 in a tripod-like support configuration. The front roller 34 is positioned over a frontal opening 36 in the base 38 of the cabinet 12, and includes a spherical roller 40 within a circular housing 42. Extending above the roller 40 and housing 42 is a bracket 44. A threaded bolt 46 extends through the bracket 44 and contacts the upper surface of the bearing 40. The rotation of the bolt 46 forces the roller 40 downward through the opening 36 so that the roller 40 provides rolling mobility for the cabinet 12. Rotation of the bolt 46 in the opposite direction allows the roller 40 to be forced upward by the weight of the cabinet 12 until the base 38 of the cabinet 12 contacts a surface on which the cabinet is to be placed.

The back rollers 34 include cylindrical rollers 50 attached to brackets 52 which are hingably mounted to the base 38 of the cabinet 12. Each of the brackets 52 is hinged so that rotation of the bracket causes the cylindrical roller 50 to either rotate downward through a rear opening 54 in the base 38 or rotate upward into the cabinet depending on the direction of rotation of the bracket. Rigidly attached to each of the brackets is a block 56 having a threaded opening 58 extending through the block. Threaded through the opening is a rod 60 having a front end which is connected by a joint 62 to a rotatable bolt 64 which extends through the front face of the cabinet 12.

The rod 60 holds the bracket 52 in a desired position. Rotation of the bolt 64 causes a corresponding rotation of the rod 60. Rotation of the rod 60 causes either a pivoting of the bracket 52 in one direction to force the roller 50 downward through the opening 54 or a pivoting of the bracket in the other direction to allow an upward retraction of the roller 50. Thus, rotation of the bolt 46 and bolts 64 causes the mixing device 10 to be supported by the front roller 46 and rear rollers 50 for selective movement of the mixing device. Once the mixing device has been placed at a desired position, such as beneath a cabinet, the bolt 46 and bolts 64 may be rotated in the opposite direction to retract rollers 32 and 34, respectively, and allow the cabinet to contact and be securely supported by the ground or other surface.

Referring to FIG. 2, the support frame 14 is rigidly attached to the cabinet 12 preferably by bolts 70. The support frame 14 includes a base 72, left and right sides 74. Spanning from one of the sides 74 to the other to form a central opening 76 is a forward rib 78 and a rear rib 80. The forward rib 78 and rear rib 80 are generally mirror images of each other.

Rotatably mounted to and horizontally extending through the support frame 14 is at least one and preferably three parallel rotary axles 82. The front end portion 84 and rear end portion 86 of each of the rotary axles is rotatably mounted in a pair of bearings 88 which are fixedly attached to the support frame 14 by being housed in appropriately sized bosses 90 formed in the support frame. A rearward end 82*a* of each of the rotary axles 82 is connected to a vertically extending crank 92. The crank 92 includes a roll pin 94 which securely fixes the rotary axle 82 to the crank.

The support frame 14 also forms a mounting base 96 to fixedly support a rotatable drive mechanism 98 such as an electric motor. Attached to a drive axle 100 of the drive mechanism 98 is a drive pulley 102. Fixedly attached to a forward end 104 of at least one of the rotary axles 82 or a driven rotary axle 105 is a driven pulley 106. A V-belt 108 extends about the drive pulley 102 and driven pulley 106 so that rotation of the drive pulley by the drive mechanism 98 causes a rotation in the driven pulley and a rotary driven axle 105.

The rigid frame 16 forms a number of bosses 112 at least corresponding in number to the number of rotary axles 82 on the support frame 14. Each of the bosses 112 house a pair of roller bearings 114 which rotatably support a horizontally extending driven axle 116. The bosses 112 are arranged and located on the rigid frame 16 so that the driven axles 116 are similarly spaced to the rotary axles 82 on the support frame 14. The driven axles 116 extend forward through the rigid frame 16 and connected to each of the cranks 94 at an offset with respect to the rotary axle 82 or at a point spaced from the point where the rotary axle 82 is connected to the crank. Thus the cranks 72 function as a means for connecting the rigid frame 16 to the support frame 14.

To minimize the depth of the cabinet 12 the rotary axles, cranks, and driven axles are configured so that the rigid frame 16 is aligned with and in close proximity to the support frame 14.

Because the driven axles 116 are similarly spaced on the support frame 14 to the spacing of the rotary axles 82 on the rigid frame 16, it is apparent that for each crank 94 the driven axle will be spaced from the rotary axles 82 a generally equal distance. Also the directional orientation between each of the drive axles 116 and the corresponding rotary axle 82 will be the same for each crank 72.

The rigid frame 16 includes a pair of arms 118 which extend forward into the central opening 76 of the support frame 14. The attachment device 18 is rigidly secured to the arms 118, preferably by bolts 120. The attachment device 18 has a bracket 122 which has a middle section 124 configured to allow the frontal insertion of a container 126 having a generally circular horizontal cross section. The bracket 122 also includes a lower generally horizontal planer plate 128 for supporting the container 126 in an upright position. To facilitate insertion and removal of the container 126, the planar plate 128 may include an upper teflon surface 129. Extending laterally from the sides of the middle section 124 is a pair of ears 130. Extending vertically upward from each of the ears 130 is a locating rod 132.

The attachment device 18 also includes an upper support member 134. The upper support member 134 includes a middle portion 136 having a generally planar lower horizontal surface 138 and a downwardly depending circumferential rim 140. The rim 140 is sized so that when the upper support member 134 is in a lower position, a position where the support member contacts the top of the container 126, the rim fits about the upper portion of the container to register and retain the container in the upright position.

The upper support member 134 also includes a pair of laterally extending ribs 142 which are configured to be vertically aligned with and extend over the ears 130 of the bracket 122. Each of the ribs 142 forms an inner orifice 144 through which the locating rods 132 extend. A resilient means or spring 146 extends about each of the locating rods 132, and has an upper end seated against the rib 142 and the lower end seated against the ear 130. The length of the spring 146 is such that when the upper support member 134 is in the lower position, the spring exerts an upwardly directed force against the upper support member which, unless the upper support member is held in the lower position, resiliently lifts the upper support member off of the container to an upper position, a position which is sufficient to clear the rim 140 from the top of the container. The spring 146 facilitates removal of the container from the attachment device 18 by insuring the upper support member 134 is resiliently placed and retained in the upper position so that the upper support member does not hinder the removal of the container 126.

Figure 3:
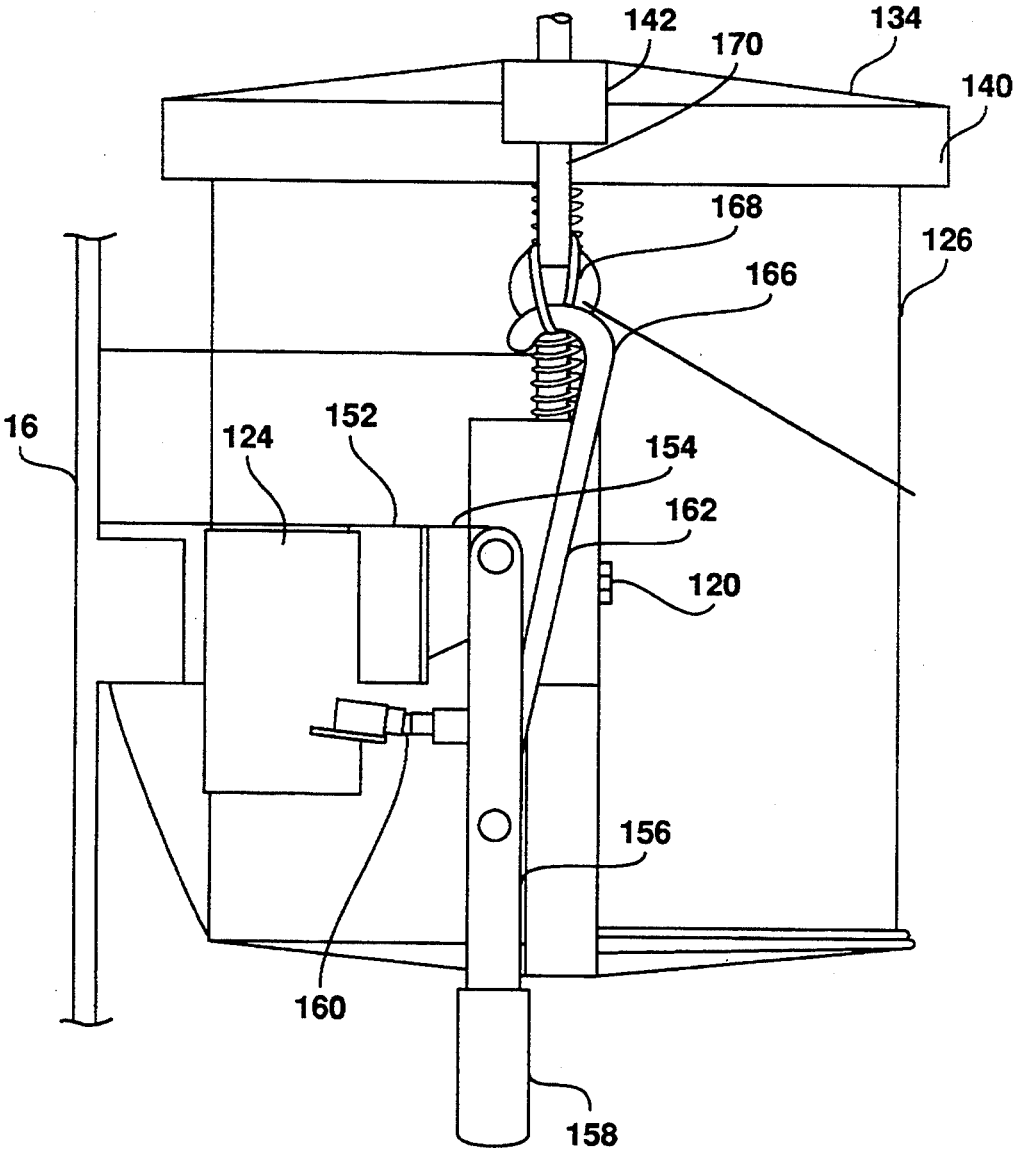
FIG. 3 is a partial side view taken generally along line 3—3 of FIG. 2 and in the direction generally indicated.

The attachment device 18 also includes a clamping device 150 to urge the upper support member 134 against the container 126. Referring to FIG. 3, the clamping device 150 includes a pair of laterally extending braces 152 which are rigidly attached to and extend outward from the middle section 124 of the bracket 122, preferably by being disposed between the bracket 122 and braces 118 with the bolts 120 extending through the braces 152. Each of the braces 152 includes a forward extending hinge member 154 to which a lever 156 is rotatably mounted. The levers 156 include handle portions 158 at the end opposite the end of the levers connected to the hinge member 154. Each of the levers 156 and braces 152 include a detachable latch means 160, such as a cabinet lock assembly, which releasably hold the lever in a downward depending position as shown in FIG. 3.

When the levers 156 are rotated to the downward depending position, the latch means 160 retain the levers in the downward position until an outward directed force is applied on the handle portions 158 by the user. The latch means 160 also functions as an indication that the levers 156 are securely held in the downward position. This indication is provided by a latching sounds when each of the latches 160 retains the corresponding lever 156, and the user may then apply a small outward force to determine that, in fact, the latch retains the lever.

Referring to FIGS. 2 and 3, the clamping device 150 also includes a pair of elongated hooks 162 one of which is rotatably attached to each of the levers 156. Each of the elongated hooks 162 includes a hook portion 166 which is received in a ring 168 attached to the lower end of an upward extending bar 170 which extends upward through an outer orifice 172 formed in each of the ribs 142. Fixedly attached to an upward end of the bar 150 is a disk like seat 174. An urging means or spring 176 extends about the bar 170 and is seated against the seat 174 and rib 142.

When the levers 156 are rotated into the downward position, the levers cause the hook 162 to pull the ring 168, bar 170 and seat 174 downward. The downward movement of the seat compresses the spring 176. The springs 176 are sized so that when the springs are compressed, the springs apply a downwardly directed urging force on the rib 142 equal to or greater than one half of the force necessary to overcome the resilient force applied on the upper support member by springs 176 and to place the upper member 134 against the top of the container 126 or in the lower position. The urging force applied by the springs 176 also securely attaches the containers to the rigid frame 16 during operation of the mixer apparatus 10. The springs 176 are also sized so that the necessary urging force is applied regardless of whether the container has a height which slightly varies. For example, it has been found that paint containers may have heights which vary by a quarter inch or so.

Referring to FIG. 1, the drive mechanism 98 is electrically connected to a timer switch 190 which is located in the front of the cabinet 12. The timer switch 190 is preferably a manual dial type timer switch. The timer switch 190 is in turn electrically connected to the sensing device 28 which prevents activation of the drive mechanism 98 if the door 24 is not secured in the closed position.

Referring to FIG. 2, in operation, the container 126 is placed on the plate 128. The left and right levers 156 are rotated into the downward position until the levers are snapped into the latch means 160 thereby indicating the container 126 is securely attached to the rigid frame 14. The downward movement of the levers 156 causes the elongated hook 162 to pull the rod 170 and connected seat 174 downward. The downward movement of the seat 174 compresses the spring 176 which then urges the upper member 134 downward into contact with the top portion of the container 126 or into the lower position.

The timer mechanism 190 is then set for the desired amount of mixing time, and the door 24 of the outer cabinet 12 is closed thereby tripping the sensing device 28 which activates the electric motor 98. The electric motor 98 rotates the drive axle 100 and drive pulley 102. The drive pulley 102 in turn rotates the driven pulley 106, rotary driven axle 115 and the crank 72 connected to the rotary driven axle. The rotation of the crank 72 connected to the rotary driven axle causes the driven axle 116 connected to that crank to circularly orbit in the vertical plane about a horizonal axis 194 or axis normal to the plane of the orbit. The horizontal axis 194 is defined by the rotating rotary axles 82 in each of the cranks. The radius of the orbit being the distance "d" between the rotary axle 82 and driven axle 116.

Because the driven axles 116 are fixedly mounted in the rigid frame 16, the orbiting of the driven axle connected to the crank 72 which is connected to the driven rotary axle 115, causes all the driven axles to orbit about the rotary axles 82 in each of the cranks. The radius of the orbits and the speed of orbiting being the same.

The orbiting of the driven axles 116 causes the rigid frame 16, and therefore the container 126, to also orbit in a vertical plane about a horizontal axis with the same rotational path and velocity as the driven axles. As the rigid frame 16 and container 126 are orbited, the rigid frame and container are maintained in the same vertical alignment. For example, the container 126 is maintained in the upright position which facilitates the intermixing of the contents of the container.

To orbit the container 126 and the rigid frame 16 centripetal forces are applied to the rigid frame by the rotary axles 82. To compensate for or balance the centripetal forces, the mixing assembly 10 also includes counterweights 196 which are connected to each of the rotary axles 82 so that the orientation between the center of mass of the counterweight and the rotary axle 82 is opposite the orientation between the driven axle 116 and the rotary axle 82. Preferably the counterweights 196 include a first set 198 which are formed integrally with each of the cranks 172. A second set 200 is securely attached to each of the rotary axles 82 within the central opening 76 adjacent the bosses 90 in the front of the support frame 14.

The orbiting of the container 126 agitates the liquid within the container causing an intermixing of the liquid. Because the container 126 is not spun around an axis of rotation, but is instead orbited around an axis in an upright position, all portions of the container are equally agitated.

The greater the radius of the orbit and the faster the rotational speed the quicker the liquid within the container is mixed; however, the greater the radius and the faster the speed the more reaction force is applied on the attachment device 18 by the container and on the rotary axles 82 by the rigid frame 16 and container 126. It has been found that by rotating the rotary driven axle 115 at about 690 RPM and offsetting the driven axles 116 from the rotary axles 82 by $\frac{7}{8}''$, produces a desired intermixing of paint within 30 seconds. By rotating the rotary driven axle at lower speeds and maintaining the same $\frac{7}{8}''$ offset the mixing time increases. Preferably the rotation is at 680–700 r.p.m. Mixing time is thus preferably maintained between 30 to 60 seconds.

After the desired mixing time has elapsed, the timer mechanism 190 stops the motor 98. The door 24 is then opened and the user grasps the handle portion 158 of the levers 156 and applies an outward directed force to detach the lever from the detachable means 160 and rotate the levers into an up position. As the levers 156 are rotated upwards, the springs 146 resiliently force and retain the upper support member 134 into the upper position. The user may then remove the container 126.

A specific embodiment of the novel mixing apparatus for liquid filled containers according to the present invention has been described for the purposes of illustrating the manner in which the invention may be made and used. It should be understood that implementation of other variations and modifications of the invention in its various aspects will be apparent to those skilled in the art, and that the invention is not limited by the specific embodiment described. It is therefore contemplated to cover by the present invention any and all modifications, variations, or equivalents that fall within the true spirit and scope of the basic underlying principles disclosed and claimed herein.

I claim:

1. A mixing assembly for a fluid in a container comprising:

a rigid frame;

a support frame;

means for removably clamping the container, said clamping means being attached to said rigid frame for supporting a lower surface of the container, an upper member adapted to fit about a top end portion of the container when said upper member is in a lower position, the top end portion of the container including a top surface, and means attached to one of said rigid frame and said supporting means and contacting said upper member for shifting said upper member from an upper position to said lower position, said member shifting means including means for urging said upper member against the top surface when said upper member is in said lower position;

said support frame including means for attaching said support frame to said rigid frame and moving the container in a planar orbit having a constant radius about a first axis.

2. The assembly of claim 1 wherein said rigid frame includes at least one first rotatable axle; said moving means including at least one second rotatable axle generally aligned with said first axle and crank means connected to a portion of said first axle and also connected to a portion of said second axle at a point spaced from said portion of said first axle, said second axle rotating said crank means wherein said portion of said first axle orbits about said portion of said second axle.

3. The assembly of claim 2 wherein said rigid frame includes a plurality of said first rotatable axles spaced about said rigid frame, said moving means includes an equal number of said second axles correspondingly spaced to said first axles and crank means connected to each of said corresponding first axles and said second axles.

4. The assembly of claim 2 wherein said moving means includes counterweight means attached to one of said second axle and said crank means for counterbalancing forces applied on said support frame by the orbital movement of said container.

5. The assembly of claim 4 wherein said counterweight means is integrally connected to said crank means.

6. The assembly of claim 1 wherein said clamping means includes, locking means operably attached to said upper member for locking said upper member in said lower position and resilient means contacting one of said rigid frame and said support means for moving said upper member to and maintaining said upper member in said upper position when said upper member is not locked into said lower position.

7. The assembly of claim 6 wherein said shifting means includes an elongated lever having a handle end and an opposite end movably attached to said support means and an intermediate portion operatively attached to a seat, said urging means including a spring having an end contacting said seat and an opposite end contacting said upper member.

8. The assembly of claim 7 wherein said resilient means includes at least one locating rod connected to and extending upward from said support means, said rod extending through said clamping means, said resilient means including a second spring disposed around said rod and having one end contacting said support means and an opposite end contacting said clamping means.

9. The mixing assembly of claim 1 wherein said rigid frame and said support frame are enclosed within a box-like cabinet.

10. The mixing assembly of claim 1 wherein said clamping means maintains the container in the same vertical orientation relative to said rigid frame during movement of the container.

11. The mixing assembly of claim 10 wherein said clamping means registers and maintains the container in an upright position during movement of the container.

12. A mixing assembly for mixing liquids within a container, said assembly comprising:

a generally vertically extending support frame defining a central opening;

a generally vertically extending rigid frame extending along a rearward side of said support frame;

attachment means connected to said rigid frame for removably clamping the container, said attachment means extending forward within said opening;

crank means for moving all of said rigid frame in a circular orbit of constant radius about a first axis, said crank means being fixedly connected to a first rotary axle extending generally horizontally through and rotatably mounted in said support frame, said crank means fixedly connected to a second rotary axle extending generally horizontally through and rotatably mounted in said rigid frame; and rotary drive means operably attached to said first rotary axle for rotating said first rotary axle wherein said second rotary axle or bits about said first rotary axle in a generally vertically plane.

13. The assembly of claim 12 wherein said securing means includes; means attached to said rigid frame for supporting a lower surface of the container, clamping means for clamping the container between said supporting means and said clamping means, said clamping means including an upper member adapted to fit about a top end portion of the container when said upper member is in a lower position, the top end portion of the container including a top surface, said clamping means including means attached to one of said rigid frame and said supporting means and contacting said upper member for moving said upper member from an upper position to said lower position, said member moving means including means for urging said upper member against the top surface when said upper member is in said lower position.

14. The assembly of claim 13 wherein said securing means includes, locking means attached to said clamping means for locking said upper member in said lower position and resilient means contacting one of said rigid frame and said support means and also contacting said clamping means for moving said upper member to and maintaining said upper member in said upper position when said upper member is not locked into said lower position.

15. The assembly of claim 13 wherein said moving means includes an elongated lever having a handle end and an opposite end movably attached to said support means and an intermediate portion operatively attached to a seat, said urging means including a spring having an end contacting said seat and an opposite end contacting said upper member.

16. The assembly of claim 15 wherein said resilient means includes at least one locating rod connected to and extending upward from said support means, said rod extending through said clamping means, said resilient means including a second spring disposed around said rod and having one end contacting said support means and an opposite end contacting said clamping means.

17. The assembly of claim 16 wherein said securing means includes; means attached to said rigid frame for supporting a lower surface of the container, clamping means for clamping the container between said supporting means and said clamping means, said clamping means including an upper member adapted to fit about a top end portion of the container when said upper member is in a lower position, the top end portion of the container including a top surface, resilient means contacting one of said rigid frame and said support means and also contacting said clamping means for moving said upper member to and maintaining said upper member in an upper position.

18. The assembly of claim 16 wherein said securing means includes; means attached to said rigid frame for supporting a lower surface of the container and resilient means contacting said clamping means for moving said upper member to and maintaining said upper member in an upper position.

19. An assembly for mixing fluids within a fluid filled container, comprising:

A generally vertically extending support frame;

a first bearing means, fixedly attached to said support frame;

a first axle horizontally extending through and rotatably mounted in said first bearing means;

a rotational drive means operatively attached to said first axle for rotating said first axle;

a crank fixedly attached to said first axle, wherein said crank spins about a horizontal axis defined by said first axle when said first axle is rotated;

a generally vertically extending rigid frame;

a second bearing means fixedly attached to said rigid frame;

a second axle extending through and rotatably mounted in said second bearing means, said second axle being generally aligned with said first axle and fixedly attached to said crank at a point spaced from the connection between said crank and said first axle, wherein said second axle orbits in a vertical plane about said horizontal axis when said crank spins about said horizontal axis; and means for removably securing the container, said securing means being secured to said rigid frame, said securing means including an upper member adapted to fit about a top end portion of the container when said upper member is in a lower position, the top end portion of the container including a top surface, and means operably attached to said rigid frame and said upper member for shifting said upper member from an upper position to said lower position, said member shifting means including biasing means for urging said upper member against the top surface when said upper member is in said lower position, the container being orbited in a vertical plane about an axis parallel to said horizontal axis by the spinning action of said crank as transmitted to the container.

20. The assembly of claim 19 wherein said crank extends generally vertical.

21. A mixing assembly for a fluid in a container comprising;

a rigid frame;

a support frame;

means for removably clamping the container, said clamping means being attached to said rigid frame for supporting a lower surface of the container, an upper member adapted to fit about a top end portion of the container when said upper member is in a lower position, the top end portion of the container including a top surface, resilient means contacting one of said rigid frame and said support means and also contacting said upper member for moving said upper member to and maintaining said upper member in an upper position;

said support frame including means for attaching said support frame to said rigid frame and moving the container in a planar orbit having a constant radius about a first axis.

* * * * *